US008632164B2

(12) United States Patent
Yamada et al.

(10) Patent No.: US 8,632,164 B2
(45) Date of Patent: Jan. 21, 2014

(54) LIQUID EJECTING APPARATUS

(75) Inventors: Yoichi Yamada, Suwa (JP); Masaru Kobashi, Suwa (JP); Toshiya Okada, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 158 days.

(21) Appl. No.: 13/402,814

(22) Filed: Feb. 22, 2012

(65) Prior Publication Data

US 2012/0212531 A1 Aug. 23, 2012

(30) Foreign Application Priority Data

Feb. 23, 2011 (JP) ..... 2011-036706

(51) Int. Cl.
*B41J 2/04* (2006.01)

(52) U.S. Cl.
USPC ..... 347/48; 347/42; 347/55

(58) Field of Classification Search
USPC ..... 347/5, 9, 10, 42, 48, 55
See application file for complete search history.

(56) References Cited

U.S. PATENT DOCUMENTS 5,477,249 A * 12/1995 Hotomi ..... 347/48
5,576,747 A * 11/1996 Sohn ..... 347/48
5,646,659 A * 7/1997 Moriyama et al. ..... 347/55
6,802,591 B2 10/2004 Takahashi
7,934,791 B2 5/2011 Masuyama et al.
2010/0231623 A1 9/2010 Hirato

FOREIGN PATENT DOCUMENTS

JP 10-278252 A 10/1998
JP 2004-148261 A 5/2004
JP 2004-202867 A 7/2004
JP 2006-062804 A 3/2006
JP 2006-175743 A 7/2006
JP 2010-214652 A 9/2010
JP 2010-214880 A 9/2010

* cited by examiner

*Primary Examiner* — Lam S Nguyen

(74) *Attorney, Agent, or Firm* — Kilpatrick Townsend & Stockton LLP

(57) ABSTRACT

A liquid ejecting apparatus includes a platen disposed with a gap from a nozzle plate of a recording head and supporting a recording medium in ejecting, and an platen application voltage generating unit generating an electric field having a direction different from an electric field generated between an individual external electrode of a piezoelectric vibrator and nozzles, between the nozzle plate and the platen, in which the intensity of the electric field generated by the applied-to-plate voltage generating unit is set in between the maximum electric field intensity and the minimum electric field intensity between the individual external electrode and the nozzles.

3 Claims, 8 Drawing Sheets

Vmax = +30 (V) Vmin = +3 (V)
d1 = 300 (μm) d2 = 2 (mm)
E1max = 100 (V/mm) E1min = 10 (V/mm)

| Vp | 0 | 50 | 100 | 150 | 200 |
|---|---|---|---|---|---|
| EFFECT | × | ○ | ○ | ○ | × |

Vmax = +30 (V) Vmin = +3 (V)

d1 = 300 (μm) d2 = 2 (mm)

E1max = 100 (V/mm) E1min = 10 (V/mm)

| Vp | 0 | 50 | 100 | 150 | 200 |
|---|---|---|---|---|---|
| EFFECT | × | ○ | ○ | ○ | × |

LIQUID EJECTING APPARATUS

This application claims priority to Japanese Patent Application No. 2011-036706, filed Feb. 23, 2011, the entirety of which is incorporated by reference herein.

BACKGROUND

1. Technical Field

The present invention relates to a liquid ejecting apparatus, such as an ink jet type recording apparatus, particularly a liquid ejecting apparatus that ejects liquid in a pressure chamber from nozzles by driving a pressure generating unit.

2. Related Art

A liquid ejecting apparatus is an apparatus equipped with a liquid ejecting head and ejecting various kinds of liquid from the ejecting head. For example, there are image recording apparatuses, such as an ink jet type printer or an ink jet type plotter, as the liquid ejecting apparatus, and recently, liquid ejecting apparatuses are used for various manufacturing apparatuses, using the feature that it is possible to accurately land a very small amount of ink to a predetermined position. For example, the liquid ejecting apparatus is used for a display manufacturing apparatus that manufactures a color filter, such as a liquid crystal display, an electrode forming apparatus that forms electrodes of an organic EL (Electro Luminescence) display or an FED (Field Emission Display), and a chip manufacturing apparatus that manufactures a biochip (biochemical element). Further, the recording head for the image recording apparatus ejects liquid-state ink and color material ejecting heads for the display manufacturing apparatus eject liquid of R (Red), G (Green), and B (Blue) color materials, respectively. Further, the electrode material ejecting head for the electrode forming apparatus ejects an electrode material and the bioorganic material ejecting head for the chip manufacturing apparatus ejects a solution of a bioorganic material.

Recently, there is a tendency for the recording head used for the printer or the like to reduce the amount of ink ejected from the nozzles due to the demand for improvement in image quality. The initial speed of droplets is set to be high to reliably land a very small amount of droplets onto a recording medium. Accordingly, the droplets ejected from the nozzle extend during scattering and are separated into main droplets at the front and satellite droplets (sub-droplets) behind the main droplets. Some or all of the satellite droplets rapidly decrease in speed due to viscous resistance of the air and change into mist, failing to reach the recording medium. Accordingly, the satellite droplet changed into mist (ink mist) contaminates the inside of the apparatus and adheres to members that are easily charged, such as the recording head or the electric circuit, thereby causing errors in operation.

It has been attempted to actively attract droplets to a support member (or a platen or a base member) supporting a recording medium during recording and land the droplets onto the recording medium by generating an electric field between a nozzle formation surface of a recording head and the support member while charging the droplets ejected from nozzles, in order to prevent the inconvenience (for example, see JP-A-10-278252 or JP-A-2004-202867).

However, as shown in the schematic view of FIG. 9A, while the ink ejected from a nozzle 64 of a recording head grows toward a recording medium P and a support member 65, negative charges are induced at the front portion (the portion that becomes a main droplet Md) close to the support member 65 by electrostatic induction from the support member 65 that has been positively charged, whereas positive charges are induced at the rear end portion close to the opposite nozzle 64. Further, as shown in FIG. 9B, when ink ejected from a nozzle is, for example, separated into main droplets Md, a first satellite droplet Sd1, and a second satellite droplet (mist) Sd2, the main droplet Md is negatively charged, the second satellite droplet Sd2 is positively charged, and the first satellite droplet Sd1 is not charged. In this case, even if the main droplet Md and the first satellite droplet Sd1 are landed on the recording medium P, the second satellite droplet Sd2 is repelled from the positively-charged support member 65 and changes into mist around the nozzle formation surface of the recording medium. Some of the mist adheres to the nozzle formation surface. When mist adheres to the nozzle formation surface, it is necessary to regularly sweep the nozzle formation surface with a wiping member. Further, the mist that does not adhere to the nozzle formation surface may adhere to other components of the printer which have different polarity from the mist and contaminate them.

Accordingly, a configuration that keeps a positively-charged satellite droplet away from a nozzle formation surface (makes a positively-charged satellite droplet travel onto a recording medium) by disposing an electrode around a nozzle, changing the polarity of the nozzle when ink starts to be ejected from the nozzle, for example, from positive to negative, and changing again the polarity of the electrode from positive at the timing when the ink ejected from the nozzle is separated into main droplets and satellite droplets, has been proposed (for example, see JP-A-2010-214652). Further, a configuration that lands droplets onto a recording medium by ejecting ink from a nozzle with a support member (base member) negatively charged, changing the polarity of the support member into positive, allowing main droplets to be landed onto the recording medium by the inertial force, and attracting satellite droplets or mist to the support member, which is charged with the opposite polarity to that of the satellite droplets or the mist, at the timing when the ink is separated into the main droplets and the satellite droplets, has been proposed (for example, see JP-A-2010-214880).

However, recently, as the driving frequency for ejecting ink becomes higher in the type of printer, the next ink is ejected from the nozzle before the satellite droplets land on the recording medium in some cases. Therefore, in the configuration of changing the polarity of the electrode at the timing of ejecting ink or the timing of separating the ink, it is more difficult to reliably land the satellite droplets to the recording medium and scattering of the ink is influenced, thereby making the landing unstable.

Further, a configuration that prevents an electric field from being generated between the nozzle formation surface and the support member may be considered to prevent the ink from being charged, but it has been known that the ejected ink is charged even though the ink is ejected from a nozzle in the configuration. That is, for example, as in the schematic view shown in FIG. 10, in the configuration of ejecting ink to the recording medium P from a nozzle 71 by generating a pressure change of ink in a pressure chamber 70 and using the pressure change, by applying driving voltage to a driving electrode 69 of a piezoelectric vibrator 68 of a recording head, when piezoelectric voltage is input to the driving electrode 69 of the piezoelectric vibrator 68, the piezoelectric vibrator 68 and the pressure chamber 70 are insulated, such that negative charges are induced in the ink in the pressure chamber 70 around the piezoelectric vibrator 68 by electrostatic induction. Further, positive charges are induced in the ink around the nozzle 71, opposite to the piezoelectric vibrator 68. In a common recording head, a nozzle formation surface 72 is grounded, such that the positive charges of the ink move to the nozzle formation surface 72, but, as described above, in the configuration of ejecting ink at a higher driving frequency, ink is ejected from the nozzle 71 with positive charges slightly remaining. As a result, the ink ejected from the nozzle 71 is positively charged.

Further, the ink ejected from the nozzle 71 has a tendency to be more positively charged (negative decreases when negatively charged and then ejected) by Lenard effect while scattered toward the recording medium P. That is, when the ink is charged, the positive charges collect to the center portion of the droplet, while the negative charges collect to the surface portion. Further, the droplets are gradually made positive by vaporization or separation of the surface portion during scattering.

As described above, since the ink ejected from the nozzle is charged even in the configuration that does not generate an electric field between the nozzle formation surface and the support member, mist adheres to the nozzle formation surface or the components of the printer.

The phenomenon described above is not limited to the piezoelectric vibrator and is also generated in other pressure generating units that are operated by applying a driving voltage, such as a heater element.

SUMMARY

An advantage of some of the aspects of the invention is to provide a liquid ejecting apparatus that can prevent the inside of the apparatus from being contaminated, by controlling the charge of droplets ejected from a nozzle.

According to an aspect of the invention, there is provided a liquid ejecting apparatus including: a liquid ejecting head that has a nozzle formation surface where nozzles ejecting liquid are formed and a pressure generating unit driven by an applied driving signal and generating a pressure change in a liquid in a pressure chamber communicating with the nozzles, and ejects the liquid toward a landing target from the nozzle by driving the pressure generating unit; a driving signal generating unit that generates a driving signal for driving the pressure generating unit; a support unit that is disposed with a gap from the nozzle formation surface of the liquid ejecting head and supports the landing target in ejecting; and an electric field generating unit that generates an electric field having a different direction from an electric field generated between the nozzles and a driving electrode of the pressure generating unit where the driving signal is supplied, between the nozzle formation surface and the support unit, wherein the intensity of the electric field generated by the electric field generating unit is set in between the maximum electric field intensity and the minimum electric field intensity between the nozzles and a driving electrode of the pressure generating unit where the driving signal is supplied.

According to the aspect, since the intensity of the electric field generated between the nozzle formation surface and the support unit by the electric field generating unit is set in between the maximum electric field intensity and the minimum electric field intensity between the driving electrode and the nozzles, the positive charges induced in the liquid around the nozzles by applying a voltage to the driving electrode of the pressure generating unit are offset and the droplets ejected from the nozzles are suppressed from being charged. As described above, even if the droplets are separated while scattering toward a landing target, such as a recording medium, and satellite droplets or mist smaller than the satellite droplets are generated, the mist is suppressed from being charged, by preventing the droplets ejected from the nozzles from being charged as much as possible, such that the less mist adheres to the components (such as the driving motor, the driving belt, and the linear scale) in the apparatus. As a result, a breakdown due to the adhering mist is prevented and durability and reliability of the liquid ejecting apparatus are improved.

In the liquid ejecting apparatus, at least a portion of the support unit may be implemented by a conductive member and the nozzle formation surface is grounded, and the electric field generating unit may charge the support unit with the same polarity as the driving electrode when the pressure generating unit is driven, by applying a voltage to the support unit.

According to this configuration, even if the nozzle formation surface is implemented by a non-conductive material, such as a monocrystal silicon substrate or a resin plate, the effect of suppressing charge of droplets ejected from the nozzles is achieved.

In the liquid ejecting apparatus, the nozzle formation surface may be implemented by a conductive member and the support unit is grounded, and the electric field generating unit may charge the nozzle formation surface with a polarity opposite to the driving electrode when the pressure generating unit is driven, by applying a voltage to the nozzle formation surface.

According to this configuration, the influence of the electric field around the liquid ejecting head decreases, such that it is possible to reliably offset the charges induced around the nozzles.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention are described hereafter with reference to the accompanying drawings. Although various limits are applied as detailed examples that are very suitable for the invention in the embodiment described below, the spirit of the invention is not limited thereto, if it is not stated to specifically limit the invention in the following description. Further, an ink jet type of recording apparatus (hereafter, printer) is exemplified below as a liquid ejecting apparatus of the invention.

Figure 1:
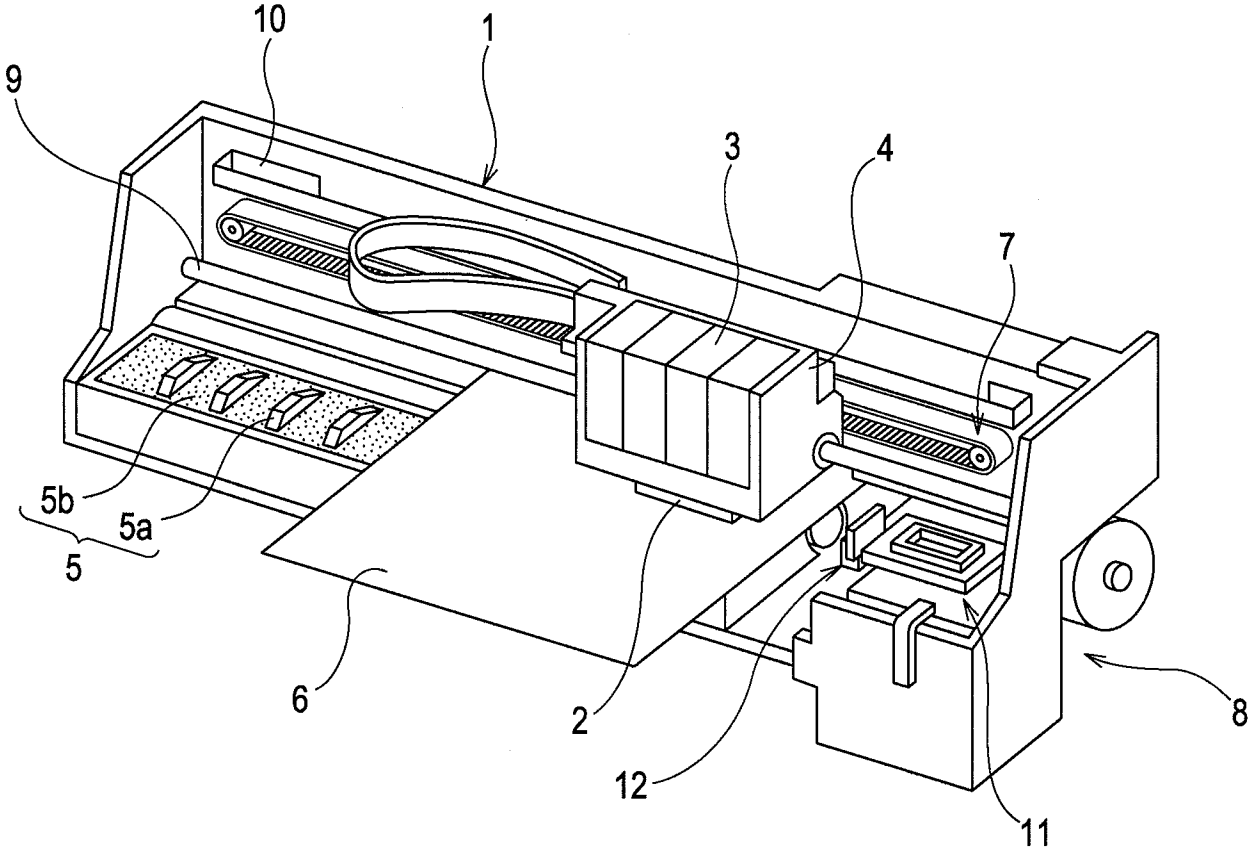
FIG. 1 is perspective view illustrating the configuration of a printer.

FIG. 1 is a perspective view showing the configuration of a printer 1. The printer 1 includes: a carriage 4 that is equipped with a recording head 2, which is a kind of liquid ejecting head, and detachably equipped with an ink cartridge 3 that is a kind of liquid supplier; a platen 5 that is disposed under the recording head 2 in recording; a carriage moving mechanism 7 that reciprocates the carriage 4 in the width direction of recording paper 6 (a kind of recording medium or a landing target), that is, in the main scanning direction; and a transport mechanism 8 that transports the recording paper 6 in the sub-scanning direction perpendicular to the main scanning direction.

The carriage 4 is fitted on a guide rod 9 held in the main scanning direction to be moved in the main scanning direction along the guide rod 9 through the operation of the carriage moving mechanism 7. The position of the carriage 4 in the main scanning direction is detected by a linear encoder 10 and the detection signal, that is, an encoder pulse (a kind of position information) is transmitted to a printer controller 51 (see FIG. 4). The linear encoder 10, a kind of position information output unit, outputs an encoder pulse EP according to the scanning position of the recording head 2 as position information in the main scanning direction.

A home position that is the start point of scanning of the carriage is set in an end region outside a recording region within the movement range of the carriage 4. A capping member 11 sealing a nozzle formation surface (nozzle plate 24, see FIG. 2) of the recording head 2 and a wiper member 12 that sweeps the nozzle formation surface are disposed at the home position in the embodiment. Further, the printer 1 can perform so-called bidirectional recording for recording characters or images on the recording paper 6 in both a forward movement when the carriage 4 moves from the home position toward the opposite end and a backward movement when the carriage 4 returns to the home position from the opposite end.

The platen 5 is a plate-shaped member that is long in the main scanning direction and a plurality of support protrusions 5*a* is formed at a predetermined intervals longitudinally on the surface. Each of the support protrusions 5*a* protrudes upward further than surface of the platen 5 (toward the recording head 2 during recording). The surface of the support protrusion 5*a* is a contact surface supporting the recording paper 6 and partially supports the back of the recording paper 6 (surface opposite the recording surface where ink is landed). Further, an ink absorbent material 5*b* is disposed at the portions without the support protrusions 5*a*, on the surface of the platen 5. The ink absorbent material 5*b* is an amorphous member, for example, made of felt or sponge and having liquid absorptiveness. At least a portion of the platen 5 of the embodiment is made of a material having electrical conductivity. For example, the platen 5 is provided with electrical conductivity by adding a conductive material, such as carbon, into the material of the main body of the platen 5. Alternatively, the ink absorbent material 5*b* may be provided with electrical conductivity by adding a conductive material into the material of the ink absorbent material 5*b*. Further, a voltage is applied to the platen 5 (the ink absorbent material 5*b* when the ink absorbent material 5*b* is provided with electrical conductivity) from a platen application voltage generating unit 58, which is described below. This is described in detail below.

Figure 2:
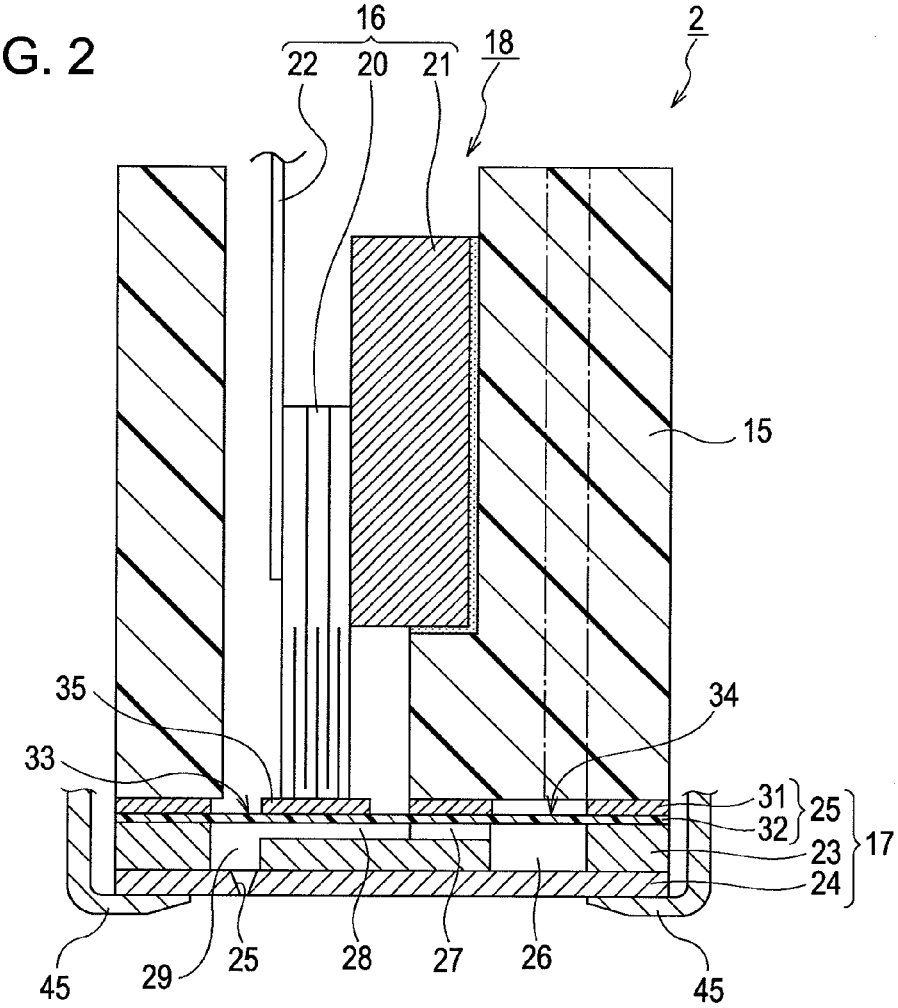
FIG. 2 is a cross-sectional view showing the main parts of a recording head.

FIG. 2 is a cross-sectional view illustrating the main parts in the configuration of the recording head 2. The recording head 2 includes a case 15, a vibrator unit 16 accommodated in the case 15, a channel unit 17 bonded to the bottom (front end surface) of the case 15, and a cover member 45. The case 15 is made of epoxy-based resin and an accommodating space 18 for accommodating the vibrator unit 16 is defined therein. The vibrator unit 16 includes a piezoelectric vibrator 20 that functions as a kind of pressure generating unit, a fixing plate 21 where the piezoelectric vibrator 20 is bonded, and a flexible cable 22 for supplying a driving signal to the piezoelectric vibrator 20.

Figure 3:
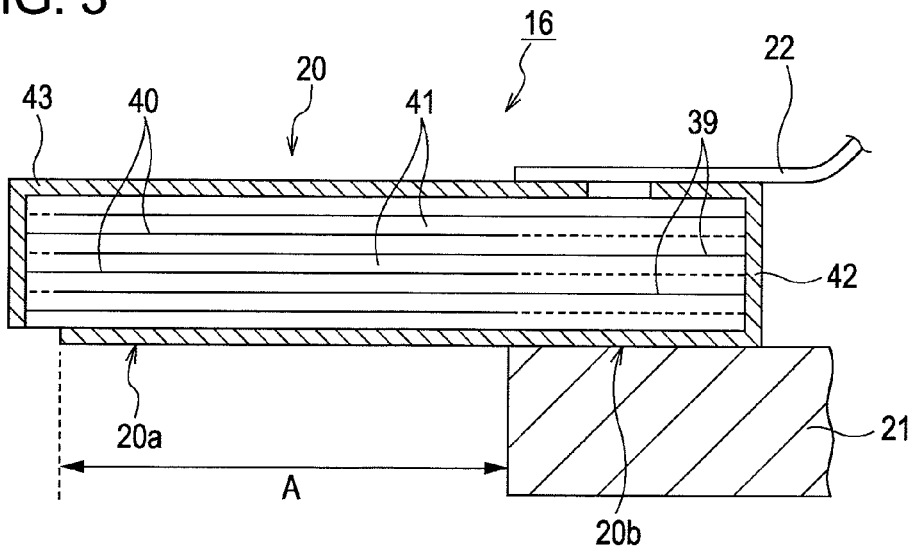
FIG. 3 is cross-sectional view illustrating the configuration of a piezoelectric vibrator.

FIG. 3 is a longitudinal cross-sectional view illustrating the configuration of the vibrator unit 16. As shown in the figure, the piezoelectric vibrator 20 is a stacking type of piezoelectric vibrator formed by alternately stacking common internal electrodes 39 and individual internal electrodes 40 with piezoelectric bodies 41 therebetween. The common internal electrodes 39 are common electrodes for the entire piezoelectric vibrator 20 and set at ground potential. Further, the individual internal electrodes 40 are electrodes that change in potential in accordance with an ejection pulse DP (see FIG. 5) of an applied driving signal. In the embodiment, the portion from the vibrator front end of the piezoelectric vibrator 20 to the halfway or approximately the ⅔ portion in the vibrator-longitudinal direction (perpendicular to the stacking direction) is a free end portion 20*a*. Further, the remaining portion of the piezoelectric vibrator 20, that is, the portion from the base end of the free end portion 20*a* to the vibrator base end is a base end portion 20*b*.

An active region (overlap) A where the common internal electrodes 39 and the individual internal electrodes 40 overlap is formed at the free end portion 20*a*. When a potential difference is given to the internal electrodes 39 and 40, the piezoelectric bodies 41 in the active region operate and deform and the free end portion 20*a* extends/contracts in the vibrator-longitudinal direction. The base ends of the common internal electrodes 39 are connected to a common external electrode 42 on the base end surface of the piezoelectric vibrator 20. Meanwhile, the front ends of the individual internal electrodes 40 are electrically connected to an individual external electrode 43 on the front end surface of the piezoelectric vibrator 20. Further, the front ends of the common internal electrodes 39 are positioned slightly ahead of the front end surface of the piezoelectric vibrator 20 (to the base end surface), while the base ends of the individual internal electrodes 40 are positioned at the interface between the free end portion 20*a* and the base end portion 20*b*.

The individual external electrode 43 (corresponding to the driving electrode in the invention) is an electrode formed in series at the front end surface of the piezoelectric vibrator 20 and a wire contact surface (upper surface in FIG. 3) that is a side in the stacking direction of the piezoelectric vibrator 20, and connects a wiring pattern of the flexible cable 22, which is a wire member, with the individual internal electrodes 40. The portion at the wire contact surface side of the individual external electrode 43 is continuously formed toward the front end side on the base end portion 20*b*. The common external electrode 42 is an electrode formed in series at the base end surface of the piezoelectric vibrator 20, the wire contact surface, and a fixing plate attachment surface (lower surface in FIG. 3) which is the opposite surface in the stacking direction of the piezoelectric vibrator 20, and connects the wiring pattern of the flexible cable 22 with the common internal electrodes 39. The portion at the wire contact surface side of the common external electrode 42 is continuously formed slight ahead of the end portion of the individual external electrode 43 toward the base end surface side and the portion at the fixing plate attachment surface is continuously formed slightly ahead of the front end surface of the vibrator toward the base end side.

The base end portion 20*b* is a non-operating portion that does not extend/contract even if the piezoelectric bodies 41 in the active region A operate. A flexible cable 22 is disposed on the wire contact surface of the base end portion 20*b*, such that the individual external electrode 43 and the common external electrode 42 and the flexible cable 22 are electrically connected, above the base end portion 20*b*. Accordingly, a driving signal is supplied to the individual external electrode 43 through the flexible cable 22.

The channel unit 17 is formed by bonding a nozzle plate 24 to a surface of a channel forming base plate 23 and bonding a vibration plate 25 to the other surface of the channel forming base plate 23. A reservoir 26 (common liquid chamber), an ink supply hole 27, a pressure chamber 28, a nozzle connection hole 29, and nozzles 30 are disposed in the channel unit 17. Accordingly, a series of ink channel is formed from the ink supply hole 27 to the nozzles 30 through the pressure chamber 28 and the nozzle connection hole 29, corresponding to the nozzles 30, respectively.

The nozzle plate 24 is a thin plate made of metal, such as stainless steel, having a plurality of nozzles 30 bored at a pitch corresponding to dot formation density (for example, 180 dpi) in a line. The nozzles 30 are disposed in lines and a plurality of nozzle lines (nozzle groups) is disposed on the nozzle plate 24, and for example, one nozzle line is composed of 180 nozzles 30. The surface where ink is ejected from the nozzles 30 of the nozzle plate 24 corresponds to the nozzle formation surface in the invention.

The vibration plate 25 has a double structure where an elastic film 32 is stacked on the surface of a support plate 31. In the embodiment, the vibration plate 25 is a composite plate member manufactured by using a stainless steel plate, which is a kind of metal plate, as the support plate 31 and laminating a resin film on the support plate 31 as the elastic film 32. A diaphragm portion 33 changing the area of the pressure chamber 28 is disposed on the vibration plate 25. Further, a compliance portion 34 sealing a portion f the reservoir 26 is disposed on the vibration plate 25.

The diaphragm portion 33 is manufactured by partially removing the support plate 31 by etching or the like. That is, the diaphragm portion 33 is composed of an island portion 35 where the front end surface of the free end portion 20*a* of the piezoelectric vibrator 20 is bonded, and a thin elastic portion surrounding the island portion 35. The compliance portion 34 is manufactured by removing the support plate 31 in the region opposite the open surface of the reservoir 26 by etching or the like, similar to the diaphragm portion 33, and has a function as a damper absorbing a pressure change in liquid stored in the reservoir 26.

Accordingly, since the front end surface of the piezoelectric vibrator 20 is bonded to the island portion 35, it is possible to change the volume of the pressure chamber 28 by extending/contracting the free end portion 20*a* of the piezoelectric vibrator 20. A pressure change in the ink in the pressure chamber 28 is caused by the change in volume. Accordingly, the recording head 2 ejects the ink from the nozzles 30 by using the pressure change.

The cover member 45 is a member protecting the sides of the channel unit 17 and the sides of the head case 15 and manufactured by a plate member having electrical conductivity, such as stainless steel. In the embodiment, a portion of the cover member 45 is in contact with the edge of the nozzle formation surface, with the nozzles 30 of the nozzle plate 24 exposed, and is electrically connected to the nozzle plate 24. The cover member 45 is grounded and connected in contact to the nozzle plate 24 in order to prevent a driving IC from being damaged or the nozzle plate 24 from being charged, for example, due to static electricity generated from the recording paper 6 and transmitted through the nozzle plate 24.

Next, the electrical configuration of the printer 1 is described.

Figure 4:
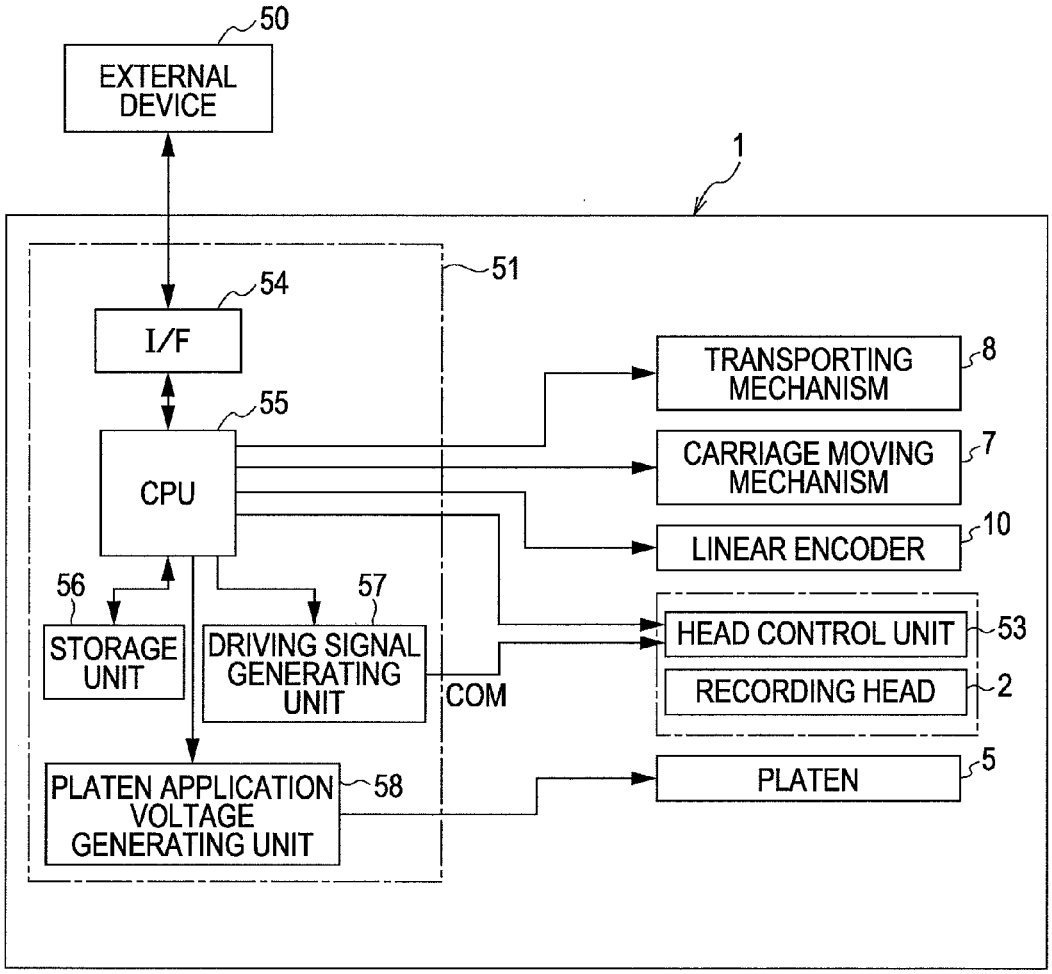
FIG. 4 is a block diagram illustrating the electrical configuration of the recording head.

FIG. 4 is a block diagram illustrating the electrical configuration of the printer 1. An external device 50 is an electronic device that handles an image, such as a computer or a digital camera. The external device 50 is connected with the printer 1 such that communication is allowable, and transmits print data according to an image or the like to the printer 1 to print an image of a text on a recording medium, such as recording paper, in the printer 1.

The printer 1 of the embodiment includes a transport mechanism 8, a carriage moving mechanism 7, a linear encoder 10, a recording head 2, and a printer controller 51.

The printer controller 51 is a control unit for controlling the parts of the printer. The printer controller 51 includes an interface (I/F) unit 54, a CPU 55, a memory unit 56, a driving signal generating unit 57, and a platen application voltage generating unit 58. The interface unit 54 transmits/receives state data of the printer, including sending print data or a print instruction to the printer 1 from the external device 50 or receiving the state information of the printer 1 with the external device 50. The CPU 55 is a calculation processing unit for controlling the entire printer. The memory unit 56 is an element storing data that is used for programs or various controls of the CPU 55 and includes a ROM, a RAM, and NVRAM (Nonvolatile Memory Element). The CPU 55 controls the units in accordance with the programs stored in the memory unit 56.

The CPU 55 functions as a timing pulse generating unit that generates a timing pulse PTS from an encoder pulse EP output from the linear encoder 10. Accordingly, the CPU 55 controls transmission of print data in synchronization with the timing pulse PTS or generation of a driving signal COM by the driving signal generating unit 57. Further, the CPU 55 generates a timing signal, such as a latch signal LAT on the basis of the timing pulse PTS and outputs the timing signal to a head control unit 53 of the recording head 2. The head control unit 53 controls the supply of an ejection pulse DP (see FIG. 5) of the driving signal COM for the piezoelectric vibrator 20 of the recording head 2 on the basis of a head control signal (print data and timing signal) from the printer controller 51.

The platen application voltage generating unit 58 (corresponding to an electric field generating unit in the invention) functions as a power source generating a voltage that is applied to the platen 5. Accordingly, the platen 5 is positively charged, that is, the piezoelectric vibrator 20 is charged with the same polarity as that of the individual external electrode 43, by applying a voltage having the same polarity as that of the driving signal to the platen 5. As described above, since the nozzle plate 24 is grounded, an electric field according to the voltage applied to the platen 5 and the distance between the platen 5 and the nozzle plate 24 is generated (d2 described below) between the platen 5 and the nozzle plate 24. This is described in detail below.

The driving signal generating unit 57 generates an analog voltage signal on the basis of the waveform data relating to the waveform of the driving signal. Further, the driving signal generating unit 57 generates a driving signal COM by amplifying the voltage signal. The driving signal COM is supplied to the piezoelectric vibrator 20 that is a pressure generating unit of the recording head 2 when printing is performed on the recording medium (during recording or ejecting), and is a series of signals including at least one or more of ejection pulses DP shown in FIG. 5, for example, within a unit period that is a repeated period. The ejection pulse DP makes the piezoelectric vibrator 20 perform a predetermined operation to eject liquid-state ink from the nozzles 30 of the recording head 2.

Figure 5:
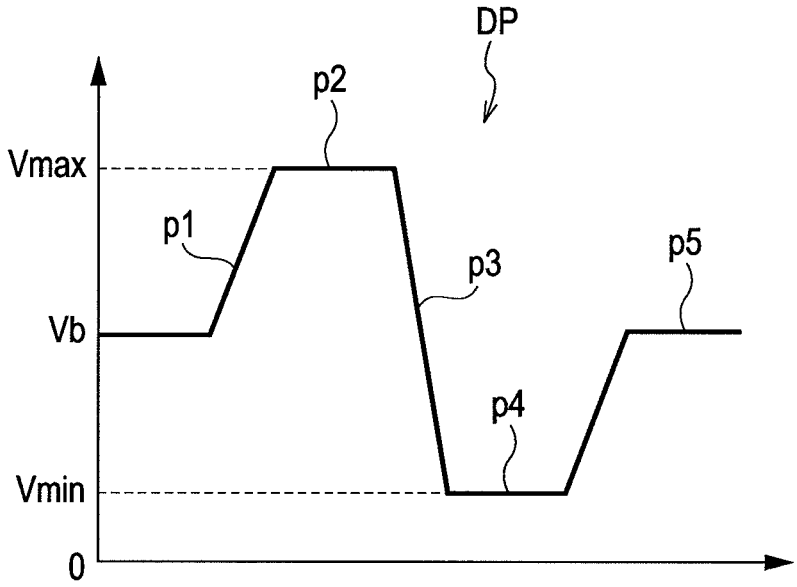
FIG. 5 is a diagram showing a waveform illustrating the configurations of an ejection pulse and a fine vibration pulse.

FIG. 5 is a waveform diagram showing an example of the configuration of the ejection pulse DP included in the driving signal COM. The vertical axis indicates potential and the horizontal axis indicates time in FIG. 5. Further, the ejection pulse DP includes an expansion factor p1 for expanding the pressure chamber 28 by changing the potential of the positive side from standard potential (intermediate potential) Vb to the maximum potential (maximum voltage) Vmax, an expansion-maintaining factor p2 for maintaining the maximum potential Vmax for a predetermined time, a contraction factor p3 for rapidly contracting the pressure chamber 28 by changing the potential at the negative side from the maximum potential Vmax to the minimum potential (minimum voltage) Vmin, a contraction-maintaining (damping-holding) factor p4 for maintaining the minimum potential Vmin for a predetermined time, and a restoring factor p5 for restoring the potential from the minimum potential Vmin to the standard potential Vb.

The following operations are generated, when the ejection pulse DP is applied to the piezoelectric vibrator 20. First, as the piezoelectric vibrator 20 is contracted by the expansion factor p1, the pressure chamber 28 expands to the maximum volume corresponding to the maximum potential Vmax from the standard volume corresponding to the standard potential Vb. Accordingly, a meniscus exposed to the nozzles 30 is attracted to the pressure chamber. The expansion of the pressure chamber 28 is kept in the application period of the expansion-maintaining factor p2. When the contraction factor p3 is applied to the piezoelectric vibrator 20, following the expansion-maintaining factor p2, the piezoelectric vibrator 20 extends and the pressure chamber 28 correspondingly rapidly contracts from the maximum volume to the minimum volume corresponding to the minimum potential Vmin. The ink in the pressure chamber 28 is pressurized by the rapid contraction of the pressure chamber 28, such that several pl to several tens of pl of ink is ejected from the nozzles 30. The contraction of the pressure chamber 28 is maintained for a short time in the application period of the contraction-maintaining factor p4, and then the restoring factor p5 is applied to the piezoelectric vibrator 20, such that the pressure chamber 28 is restored to the standard volume corresponding to the standard potential Vb from the volume corresponding to the minimum potential Vmin.

In the printer 1 of the embodiment, since the platen 5 is charged with the same polarity as that of the individual external electrode 43, when the piezoelectric vibrator 20 is driven, by applying a voltage to the platen 5 by using the platen application voltage generating unit 58, the ink ejected from the nozzles 30 of the recording head 2 is not charged.

Figures 6, 7:
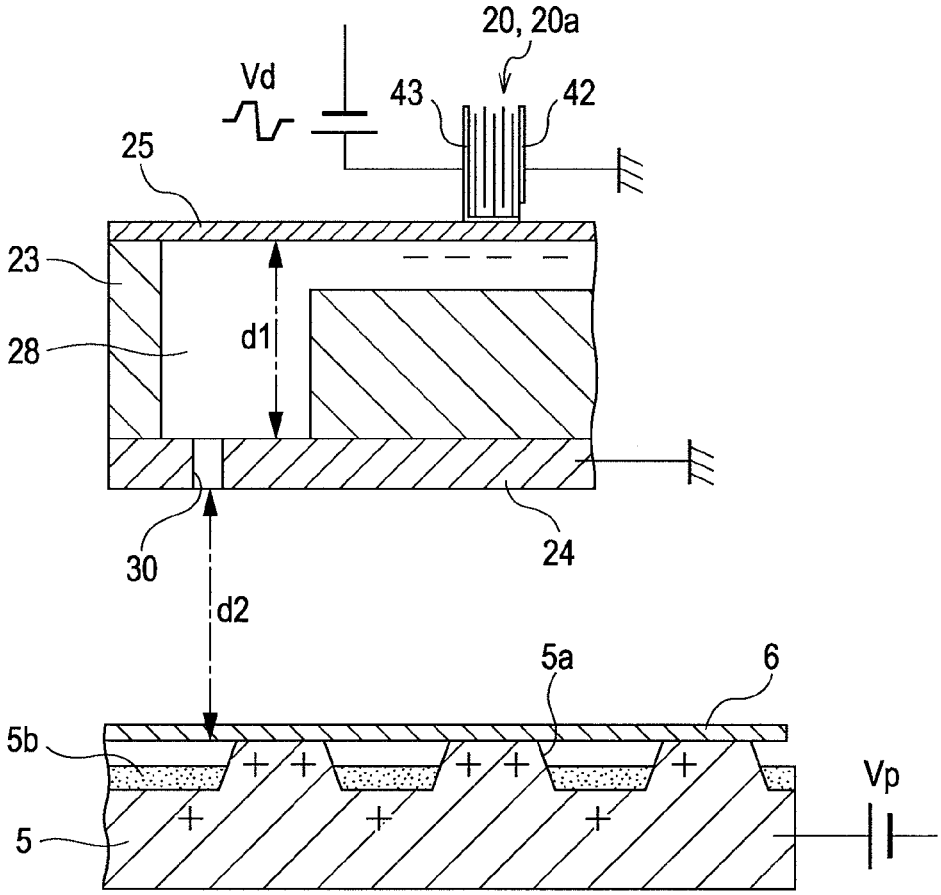
FIG. 6 is a schematic view illustrating unchanging of ink when the ink is ejected.
FIG. 7 is a table showing the relationship between a platen application voltage and an effect of suppressing charge of mist.

FIG. 6 is a schematic view illustrating uncharging of ink when the ink is ejected.

As described above, since the nozzle plate 24 is grounded through the cover member 45, a potential difference and an electric field are generated between the platen 5 and the nozzle plate 24 by positively charging the platen 5. The direction of the electric field is different from (opposite to) the direction of the electric field generated between the nozzles 30 and the individual external electrode 43 of the piezoelectric vibrator 20 when ink is ejected from the nozzles 30. Accordingly, it is possible to suppress the ink ejected from the nozzles 30 from being charged, by adjusting the electric field intensity. In detail, the electric field intensity between the platen 5 and the nozzle plate 24 is set to a value between the maximum electric field intensity and the minimum electric field intensity of the electric field generated between the individual external electrode 43 and the nozzles 30.

When the distance between the individual external electrode 43 and the nozzles 30 of the piezoelectric vibrator 20 is d1, the distance from the nozzles 30 to the upper surface (support protrusions 5*a*) of the platen 5 is d2, the voltage applied to the individual external electrode 43 is Vd, and the voltage applied to the platen 5 is Vp, the maximum electric field intensity E1 between the individual external electrode 43 and the nozzles 30 is expressed by E1=Vd/d1 and the electric field intensity E2 between the platen 5 and the nozzle plate 24 is expressed by E2=Vp/d2. As the ejection pulse Dp is applied to the individual external electrode 43 of the piezoelectric vibrator 20, the average of the electric field intensity generated between the individual external electrode 43 and the nozzles 30 while the ink is ejected is substantially in between the electric field intensity E1max (=Vmax/d1) at the maximum voltage Vmax of the ejection pulse DP and the electric field intensity E1min (=Vmin/d1) at the minimum voltage Vmin of the ejection pulse DP. Therefore, the applied voltage Vp (=d2×(E1max+E1min)/2) applied to the platen 5 is set such that the electric field intensity E2 between the platen 5 and the nozzle plate 24 is (E1max+E1min)/2, such that an electric field offsetting the electric field between the individual external electrode 43 and the nozzles 30 is generated between the platen 5 and the nozzle plate 24.

For example, for Vmax=+30 (V), Vmin=+3 (V), d1=300 (μm), and d2=2 (mm), E1max=30/0.3=100 (V/min) and E1min=3/0.3=10 (V/mm) are satisfied. Accordingly, the applied voltage Vp=d2×(E1max+E1min)/2=+82.5 (V) is satisfied. Further, the applied voltage Vp may not necessarily satisfy E2=(E1max+E1min)/2 and may be set, for example, as Vpmin=d2×E1min, and accordingly, it is possible to achieve an effect of suppressing the electric field between the individual external electrode 43 and the nozzles 30, by setting Vpmax=d2×E1max to a value between Vpmin to Vpmax. That is, in this example, a value within +15 to +150 (V) is used as Vp, because of Vpmin=+15 (V) and Vpmax=+150 (V).

By using the configuration described above, the positive charges induced around the nozzles 30 by the voltage applied to the individual external electrode 43 are offset and the ink ejected from the nozzles 30 is suppressed from being charged. As described above, even if the ink is separated while scattering toward the recording medium, such as the recording paper 6, and satellite droplets or mist smaller than the satellite droplets are generated, the mist is suppressed from being charged, by preventing the ink ejected from the nozzles 30 from becoming charged as much as possible, such that less mist adheres to the components (easily chargeable components, such as the driving motor, the driving belt, and the linear scale) in the printer. As a result, a breakdown due to the adhering mist is prevented and durability and reliability of the printer 1 are improved. Further, according to the configuration, not limited to the exemplified metal product, it is possible to achieve the effect to suppress the ink ejected from the nozzles 30 from being charged, even if the nozzle plate 24 is implemented by a monocrystal silicon substrate or a non-conductive material, such as a resin plate.

FIG. 7 is a table showing the relationship between the applied voltage Vp of the platen and the effect of suppressing charge of mist. As shown in the stable, when Vp is set to 0 (V) (that is, when a voltage is not applied), the electric field between the individual external electrode 43 and the nozzles 30 is not offset, such that the effect of suppressing charge of mist is not achieved (x). Similarly, when Vp is set to 200 (V), that is, set not less than Vpmax, the mist is caused to be charged (x). On the other hand, when Vp is set to a value within the range of +15 to +150 (V) (50 (V), 100 (V), and 150 (V) in the example), the effect of suppressing charge of mist could be achieved for any case (○).

However, the invention is not limited to the embodiment described above and may be modified in various ways on the basis of the aspects described in claims.

Figure 8:
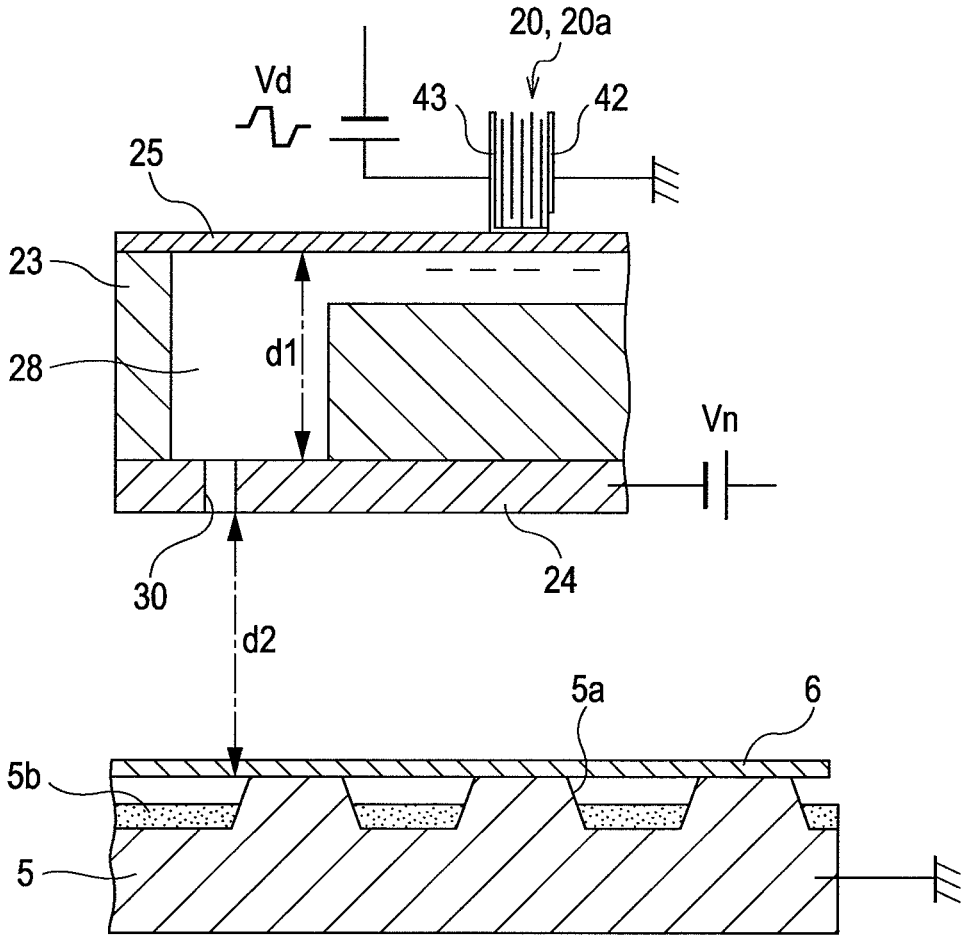
FIG. 8 is a schematic view illustrating the configuration of a second embodiment.
Figure 9A:
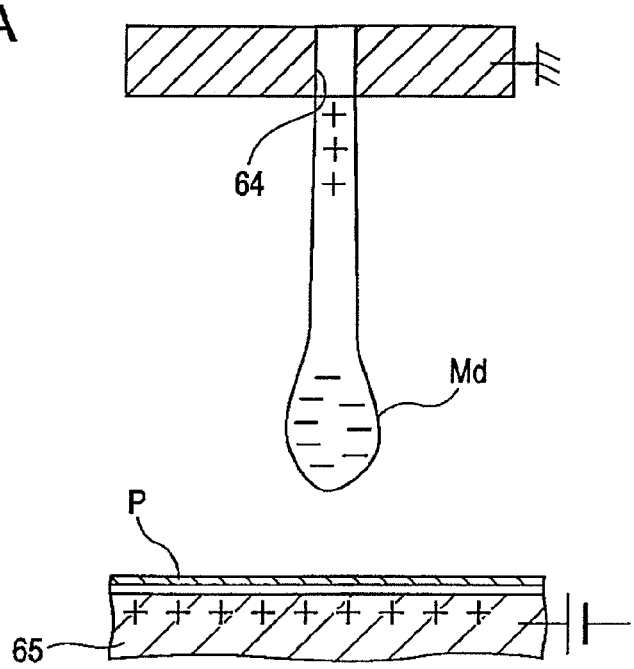
FIGS. 9A and 9B are schematic views illustrating when ink ejected from a nozzle is charged in a configuration where an electric field is generated between the nozzle and a support member.
Figure 9B:
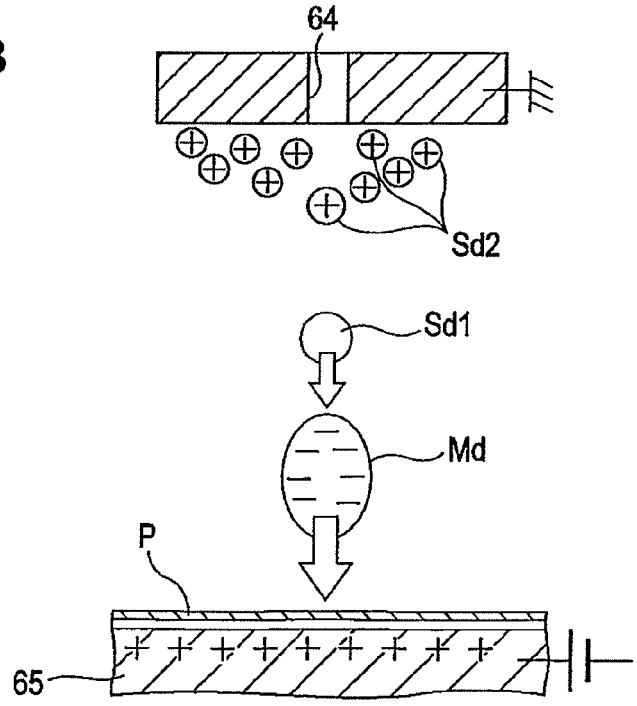
Figure 10:
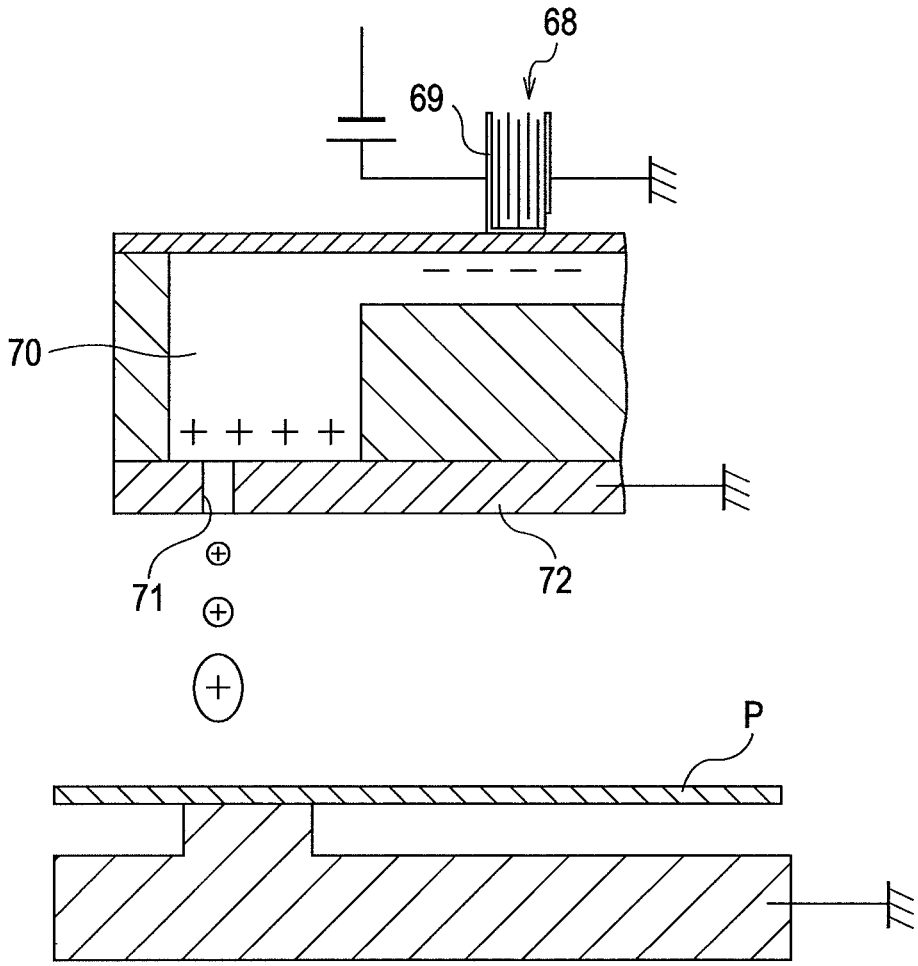
FIG. 10 is a schematic view illustrating when ink ejected from a nozzle is charged in a configuration where an electric field is not generated between the nozzle and a support member.

FIG. 8 is a schematic view illustrating a second embodiment of the invention.

Although the first embodiment exemplifies when the nozzle plate 24 is grounded and the platen 5 is charged with the same polarity as that of the individual external electrode 43 by applying voltage to the platen 5, the invention is not limited thereto. In the second embodiment shown in FIG. 8, the platen 5 is grounded, while a voltage having a polarity (negative in the example) opposite to the polarity of the driving signal is applied to the nozzle plate 24, such that the nozzle plate 24 is charged with a polarity opposite to the polarity of the individual external electrode 43, which is different from the first embodiment. Even in the configuration, the applied voltage Vn (=−d2×(E1max+E1min)/2) applied to the nozzle plate 24 is set such that the electric field intensity E2 between the platen 5 and the nozzle plate 24 is (E1max+E1min)/2, such that an electric field offsetting the electric field between the individual external electrode 43 and the nozzles 30 is generated between the platen 5 and the nozzle plate 24. For example, for Vmax=+30 (V), Vmin=+3 (V), d1=300 (m), and d2=1.5 (mm), the applied voltage Vn=−d2×(E1max+E1min)/2=−82.5 (V) is satisfied. Similar to the applied voltage Vp for the platen 5, when the applied voltage Vn is set to a value between Vnmin to Vnmax, as Vnmax=−d2×E1min and Vnmin=−d2×E1max, an effect of suppressing the electric field between the individual external electrode 43 and the nozzles 30 is achieved. That is, in this example, a value within −150 to −15 (V) is used as Vn, because of Vnmin=−150 (V) and Vnmax=−15 (V). According to the configuration, as compared with the configuration of the first embodiment, the influence of the electric field around the recording head 2 decreases, such that it is possible to more reliably offset the charges induced around the nozzles 30.

Further, although the embodiments exemplify the so-called longitudinal vibration type of piezoelectric vibrator 20 as a pressure generating unit, the invention is not limited thereto and may use a so-called flexural vibration type of piezoelectric vibrator. In this case, as shown in FIG. 5, the waveform of the driving signal (ejection pulse DP) becomes a waveform with the direction of potential changed, that is, an upside-down waveform. Further, a configuration using a pressure generating unit driven by receiving a voltage, such as a heater element generating a pressure change by bumping ink by generating heat or an electrostatic actuator generating a pressure change by moving a separation wall of a pressure chamber by using an electrostatic force, may also be applied to the invention.

Further, as long as it is a liquid ejecting, apparatus that can control ejection of liquid by using a pressure generating unit, the invention is not limited to a printer and may also be applied to a variety of ink jet type of recording apparatuses, such as a plotter, a facsimile, and a copy machine, or a liquid ejecting apparatus other than the recording apparatuses, such as a display manufacturing apparatus, an electrode manufacturing apparatus, and a chip manufacturing apparatus. Accordingly, in the display manufacturing apparatus, liquid having color materials of R (Red), G (Green), and B (Blue) is ejected from a color material ejecting head. Further, in the electrode manufacturing apparatus, a liquid-state electrode material is ejected from an electrode material ejecting head. In the chip manufacturing apparatus, liquid of a bioorganic material is ejected from a bioorganic material ejecting head.

The entire disclosure of Japanese Patent Application No. 2011-036706, filed Feb. 23, 2011 is expressly incorporated by reference herein.

What is claimed is:

1. A liquid ejecting apparatus comprising:

a liquid ejecting head that has a nozzle formation surface where nozzles ejecting liquid are formed and a pressure generating unit driven by an applied driving signal and generating a pressure change in a liquid in a pressure chamber communicating with the nozzles, and ejects the liquid toward a landing target from the nozzle by driving the pressure generating unit;

a driving signal generating unit that generates a driving signal for driving the pressure generating unit;

a support unit that is disposed with a gap from the nozzle formation surface of the liquid ejecting head and supports the landing target in ejecting; and an electric field generating unit that generates an electric field having a different direction from an electric field generated between the nozzles and a driving electrode of the pressure generating unit where the driving signal is supplied, between the nozzle formation surface and the support unit, wherein the intensity of the electric field generated by the electric field generating unit is set in between the maximum electric field intensity and the minimum electric field intensity between the driving electrode and the nozzles.

2. The liquid ejecting apparatus according to claim 1, wherein at least a portion of the support unit has a conductive member and the nozzle formation surface is grounded, and the electric field generating unit charges the support unit with the same polarity as the driving electrode when the pressure generating unit is driven, by applying a voltage to the support unit.

3. The liquid ejecting apparatus according to claim 1, wherein the nozzle formation surface has a conductive member and support unit is grounded, and the electric field generating unit charges the nozzle formation surface with a polarity opposite to the driving electrode when the pressure generating unit is driven, by applying a voltage to the nozzle formation surface.

* * * * *